US008646579B2

(12) United States Patent
Schuster

(10) Patent No.: US 8,646,579 B2
(45) Date of Patent: Feb. 11, 2014

(54) CIRCUIT BOARD COUPLING ELEVATOR CALL CONTROL TO SIGNAL BUS

(75) Inventor: Kilian Schuster, Emmenbrucke (CH)

(73) Assignee: Inventio AG, Hergiswil (CH)

( * ) Notice: Subject to any disclaimer, the term of this patent is extended or adjusted under 35 U.S.C. 154(b) by 481 days.

(21) Appl. No.: 12/990,329

(22) PCT Filed: Apr. 29, 2008

(86) PCT No.: PCT/EP2008/055259
§ 371 (c)(1),
(2), (4) Date: Jan. 14, 2011

(87) PCT Pub. No.: WO2009/132697
PCT Pub. Date: Nov. 5, 2009

(65) Prior Publication Data

US 2011/0120814 A1 May 26, 2011

(51) Int. Cl.
*B66B 1/28* (2006.01)

(52) U.S. Cl.
USPC ..... 187/247; 187/391

(58) Field of Classification Search
USPC ..... 187/247, 248, 380–388, 391–393
See application file for complete search history.

(56) References Cited

U.S. PATENT DOCUMENTS

| | | | | |
|---|---|---|---|---|
| 4,844,204 | A * | 7/1989 | Ovaska et al. | 187/247 |
| 5,352,857 | A * | 10/1994 | Ovaska | 187/247 |
| 5,389,748 | A * | 2/1995 | Burke et al. | 187/247 |
| 6,892,861 | B2 * | 5/2005 | Friedli | 187/247 |
| 6,935,465 | B2 * | 8/2005 | Friedli | 187/247 |
| 7,416,058 | B2 * | 8/2008 | Marterer | 187/391 |
| 7,900,750 | B2 * | 3/2011 | Mattsson et al. | 187/247 |
| 7,918,318 | B2 * | 4/2011 | Friedli et al. | 187/247 |
| 8,172,043 | B2 * | 5/2012 | Hughes et al. | 187/382 |
| 2011/0308891 | A1 * | 12/2011 | Friedli | 187/247 |

FOREIGN PATENT DOCUMENTS

| | | | |
|---|---|---|---|
| EP | 1308409 | A | 5/2003 |
| EP | 1535874 | A | 6/2005 |
| EP | 1900672 | A | 3/2008 |

* cited by examiner

*Primary Examiner* — Anthony Salata
(74) *Attorney, Agent, or Firm* — Fraser Clemens Martin & Miller LLC; William J. Clemens

(57) ABSTRACT

An elevator installation has at least one terminal and at least one call control. The terminal communicates data with respect to an input floor and a destination floor to the call control by way of at least one signal bus. The call control is arranged on a first plug-in card. At least one signal-bus adapter for the signal bus is arranged on a second plug-in card. The first plug-in card and the second plug-in card are directly connected together to form a circuit board.

18 Claims, 3 Drawing Sheets

CIRCUIT BOARD COUPLING ELEVATOR CALL CONTROL TO SIGNAL BUS

FIELD OF THE INVENTION

The disclosure relates to an elevator installation and to a call control for use in an elevator installation.

BACKGROUND OF THE INVENTION

An elevator installation with terminals, a job manager for the call control, an elevator control and elevator car is known from EP 1308409 A1, in which a passenger inputs an identification code at a terminal on an input floor, whereupon a passenger profile of a databank with a predefined destination floor is allocated to the identification code. The terminal communicates data with respect to the input floor and with respect to the destination floor of the passenger to the call control. From these data, the call control determines travel orders and communicates the travel orders to the elevator control. The elevator control controls, by these travel orders, the elevator car and transports the passenger from the input floor to the destination floor. Whereas the terminal, the data memory and the call control communicate by way of a signal bus such as Local Operating Network (LON) or Ethernet, the call control and the elevator control communicate by way of a parallel logic bus. In at least some cases, the databank and the call control are constructed as a circuit board, which circuit board comprises, apart from an adapter relative to the signal bus, also an interface relative to the parallel logic bus.

SUMMARY OF THE INVENTION

At least some embodiments of the disclosed technologies relate to an elevator installation with at least one terminal and at least one call control component. The terminal communicates data with respect to an input floor and with respect to a destination floor to the call control component by way of at least one signal bus. The call control component is arranged on a first plug-in card. At least one signal-bus adapter for the signal bus is arranged on a second plug-in card. The first plug-in card and the second plug-in card are directly connected together to form a circuit board.

By signal bus there is understood a communications connection in which all participants in a communication are directly addressable by way of a single transmission path, be it by electric current, light or radio. A multiplicity of different signal buses currently exists. Some embodiments allow for the multiplicity of signal buses to be managed in that the call control component and the signal-bus adapter of the call control component for the communication with the terminal are arranged on different plug-in cards. In this manner the call control can be produced in large piece numbers in standardized form and economically on a first plug-in card and, depending on the signal bus required for the communication with the terminal, can be directly connected with a corresponding signal-bus adapter of a second plug-in card to form a circuit board.

In further embodiments, at least one databank of the elevator installation with at least one passenger profile and/or elevator profile is arranged together with the call control component on the first plug-in card or at least one databank of the elevator installation with at least one passenger profile and/or elevator profile is arranged on a further first plug-in card.

In some cases, not only the call control, but also a databank can be produced in large piece numbers in standardized form and economically on a first plug-in card.

The first plug-in card and the second plug-in card can be reversibly connected together by way of at least one first plug-in connection to form a circuit board. In some embodiments the first and second plug-in cards can be simply and quickly connected together without soldering and also detached again. In the case of a defect in a circuit board the defective plug-in card can then be simply and quickly replaced. Thus, a maintenance engineer in the event of a defect of a circuit board of an elevator installation can simply and quickly extract a first plug-in card with the call control component from a first store and extract a second plug-in card with the signal-bus adapter specific to the elevator installation from a second store and connect these ad hoc by way of the first plug connection to form the circuit board.

In some cases the call control creates, based on the communicated data, travel orders and communicates these travel orders to an address of the elevator control by way of at least one serial bus. In some embodiments, at least one serial-bus adapter for the serial bus is arranged on the second plug-in card. In further embodiments, at least one serial bus adapter for the serial bus is arranged on a third plug-in card. The second plug-in card and the third plug-in card are directly connected together.

This can be beneficial, since not only the multiplicity of signal buses, but also the multiplicity of serial buses can be managed by dedicated plug-in cards. Since elevator installations are long-term capital cost assets it is quite usual for them to be in operation for 30 and more years. Since the industry standards for serial buses change substantially more quickly, a large number of serial buses inevitably arises with time.

In some embodiments, the second plug-in card and the third plug-in card are reversibly connected together by way of at least one second plug connection.

This can allow the second and third plug-in cards to be connected together simply and quickly without soldering and also detached again. In the event of a defect of a plug-in card then the defective plug-in card can be simply and quickly replaced.

In further embodiments, exactly one call control is connected by way of the serial bus with exactly one elevator control.

This can be beneficial, since the serviceability of the elevator installation with several elevators is thus not affected by the call control. In at least some cases, exactly one elevator control and exactly one call control are provided per elevator.

In additional embodiments, at least one electrical power connection is arranged on the second plug-in card. The electrical power connection supplies all components of the circuit board with electrical power. In further embodiments, the electrical power connection is integrated in at least one signal-bus adapter for the signal bus and/or in at least one serial-bus adapter for the serial bus. In still more embodiments, the second plug-in card comprises several electrical power connections.

This can be beneficial, since the second plug-in card thus not only enables the communication of the call control or databank in the signal bus, but also provides the electrical power supply. The serviceability of the elevator installation can also be increased, since the circuit board is supplied with electrical power in redundant manner, for example by way of an electrical power connection from the elevator control and by way of the signal-bus adapter from the signal bus. In the event of power failure of the elevator control the signal-bus adapter is thus still supplied with electrical power by way of the signal bus and the communication between the terminal and the call controls in the signal bus is still possible.

In particular cases, the circuit board is mounted in a push-in unit of a terminal or an elevator control.

In such cases the call control can thus be pushed in simple and space-saving manner into existing components of the elevator installation.

In some embodiments, the terminal communicates with the call control by way of a first signal bus, whilst the call control and at least one databank and/or at least one safety databank of the elevator installation communicate with one another by way of a signal bus.

This can provide that an economic, robust LON bus with a long transmission path can be used as first signal bus, whilst an Ethernet network with a high transmission rate and short transmission path can be used as second signal bus.

In further embodiments, at least one destination floor code is recognized by the terminal on an input floor and at least one destination floor is allocated to the destination floor code. In additional embodiments, at least one identification code is recognized by the terminal on an input floor. The identification code is communicated by the terminal to an address of at least one databank of the elevator installation by way of the signal bus. The databank allocates to the identification code at least one predefined destination floor from at least one passenger profile. The destination floor is communicated by the databank to an address of the terminal on the input floor by way of the signal bus. In some embodiments, a passenger profile with data with respect to at least one access authorization, in terms of space and/or time, of at least one passenger, who is identified by the identification code, to floors and spaces of a building as well as to at least one predefined destination floor of the passenger in the building is kept by the databank. It can be checked by the databank for an identification code whether the conditions, in terms of time and/or space, of the access authorization are fulfilled and in the case of fulfillment of conditions a predefined destination floor from the passenger profile is allocated by the databank to the identification code.

This can allow contactless recognition of a destination floor code or an identification code as well as the allocation of a destination floor to a recognized destination floor code or a predefined floor to a recognized identification code. The latter can provide access control, since a destination floor is allocated only to passengers with access authorization.

In some embodiments, data with respect to the input floor as well as with respect to the destination floor are communicated by the terminal to an address of the call control by way of the signal bus. Based on the communicated data with respect to an input floor and with respect to a destination floor, travel orders for an elevator control are created by the call control. Data with respect to the travel orders are communicated by the call control to an address of the terminal on the input floor by way of the signal bus. Based on the communicated data with respect to an input floor and with respect to a destination floor, travel orders for a first elevator control are created by a first call control and, based on the communicated data with respect to an input floor and with respect to a destination floor, travel orders for a second elevator control are created by a second call control. Data with respect to the travel orders are communicated as destination call offers by the call controls to an address of the terminal on the input floor by way of the signal bus. A destination call offer is selected by the terminal and a selection acknowledgement of the selected destination call offer is communicated by the terminal to the address of the call control of the selected destination call offer by way of the signal bus.

This can allow the terminal to select from several destination call offers the most favorable, namely that which transports the passenger most rapidly to the destination floor.

In some embodiments, an optical and/or acoustic acknowledgement of the travel requests is issued by the terminal on at least one output device.

In further embodiments, the travel orders are communicated by the call control to an address of at least one elevator control of the elevator installation by way of at least one serial bus.

In some embodiments, in the event of failure of an elevator of the elevator installation travel orders for the elevator control of the failed elevator are no longer created by the call control of the failed elevator. However, travel orders for the elevator control of a non-failed elevator are then still created by a call control of the non-failed elevator. At least one passenger profile of the databank can be replicated to an address of at least one safety databank by way of the signal bus.

Thus, even in the event of failure of an elevator travel requests can still be created by the call control of a non-failed elevator or that in the event of failure of a databank a safety databank is available, which increases the serviceability of the elevator installation. In the case of an elevator installation with four elevators, wherein each elevator has an own call control, the failure of an elevator thus leads to loss of a quarter of the capacity of the elevator installation. The serviceability of the elevator installation is not affected by the call control.

In some cases, at least one elevator profile with data with respect to positioning, in terms of space and/or time, of the at least one elevator car in at least one elevator shaft is kept by the databank. It can be checked by the databank whether the conditions, with respect to time and/or space, of an elevator positioning are fulfilled and in the case of fulfillment of conditions at least one travel command for elevator positioning is communicated by the databank to an address of the call control of the elevator car by way of the signal bus, and, based on the communicated data with respect to elevator positioning, at least one travel command is communicated by the call control to an address of an elevator control of the elevator car by way of the serial bus.

Thus the elevator car can be optimally positioned in the building with respect to rush hours.

In further embodiments, an existing elevator installation is retrofitted to form an elevator installation according to the invention in that at least one terminal is installed, whereupon at least one circuit board with at least one call control on a first plug-in card is installed. The terminal is now connected by way of at least one signal bus with at least one signal-bus adapter on a second plug-in card of the circuit board and the call control is connected with at least one existing elevator control by a serial-bus adapter on a second plug-in card and/or a third plug-in card by way of at least one serial bus.

This can allow a terminal to be installed simply and quickly, for example by screw connections at a building wall, since the circuit board is similarly installed simply and quickly, for example by pushing into an elevator control, and since in addition the connection with the signal bus and with the serial bus is managed simply and quickly.

In additional embodiments, at least one terminal is installed on each floor served by the existing elevator installation. Advantageously at least one existing terminal is removed or dissimulated or deactivated on at least one floor and/or in at least one elevator car.

In further embodiments, a computer program product comprises at least one computer program device which is suitable for realizing the method of operating an elevator installation in that at least one method step is executed when the computer program means is loaded into at least one processor of at least one terminal or at least one call control or at least one databank or at least one safety databank of the elevator installation or at least one elevator control of the elevator installation. A computer readable data memory comprises such a computer program product.

DESCRIPTION OF THE DRAWINGS

Exemplifying embodiments of the disclosed technologies are explained in detail by way of the figures, with respect to which, in partly schematic form.

DESCRIPTION OF PREFERRED EMBODIMENTS

Figure 1:
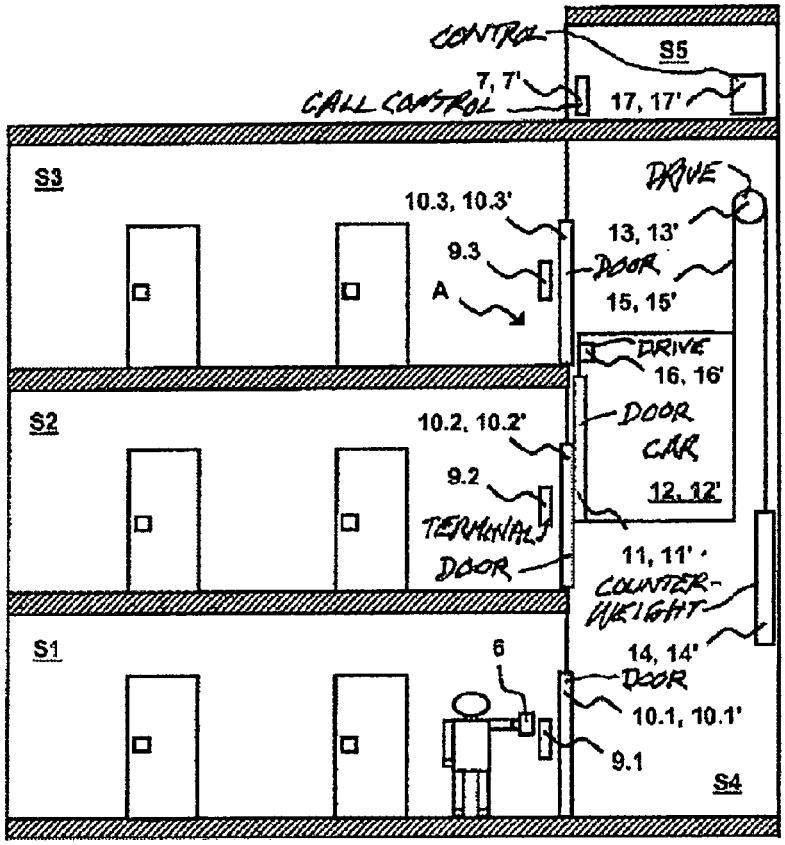
FIG. 1 shows a partially sectioned view of a part of an exemplifying embodiment of the invention with an elevator installation with a terminal and a call control.

FIG. 1 shows an exemplifying form of embodiment of a building with several horizontal floors S1, S2, S3 and spaces with building doors. The building has three floors S1, S2, S3 with two building doors per floor S1, S2, S3. Each building door gives access to a space of the building. An elevator installation A is disposed in at least one vertical elevator shaft S4 and in an engine room S5. According to FIG. 1, two elevators are arranged with a respective elevator car 12, 12', a respective counterweight 14, 14', a respective support 15, 15', a respective elevator drive 13, 13' and a respective door drive 16, 16' in the elevator shaft S4 and with a respective elevator control 17, 17' arranged in the engine room S5. The elevator car 12, 12' is connected with the counterweight 14, 14' by way of at least one support 15, 15'. For movement of the elevator car 12, 12' and counterweight 14, 14' the support 15, 15' is set in motion by at least one elevator drive 13, 13' in frictional couple. At least one passenger has access to the elevator car 12, 12' by way of at least one elevator door 10.1, 10.1', 10.2, 10,2', 10.3, 10.3'. The elevator door 10.1, 10.1', 10.2, 10.2', 10.3, 10.3' forms on each floor S1, S2, 83 the closure of the floor S1, S2, S3 relative to the elevator shaft S4. The opening and closing of the elevator door 10.1, 10.1', 10.2, 10.2', 10.3, 10.3' is effected by way of the door drive 16, 16'. The door drive 16, 16' is usually arranged at the elevator car 12, 12' and actuates at least one car door 11, 11'. During a floor stop the car door 11, 11' can be brought into operative connection with the elevator doors 10.1, 10.1', 10.2, 10.2', 10.3, 10.3' by mechanical coupling in such a manner that opening and closing of the car door and the elevator doors 10.1, 10.1', 10.2, 10.2', 10.3, 10.3' takes place simultaneously.

Figure 2:
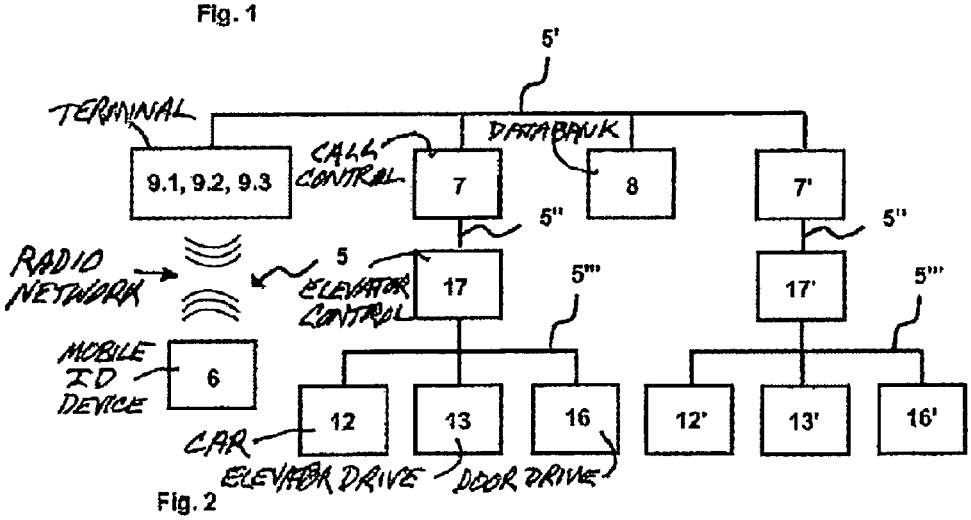
FIG. 2 shows an illustration of the communication paths in the exemplifying embodiment of the elevator installation according to FIG. 1.

The elevator control 17, 17' comprises at least one processor and at least one computer readable data memory and at least one electrical power supply. According to FIG. 2 each elevator control 17, 17' is connected by way of at least one signal line 5''' with components of the elevator, such as elevator car 12, 12', elevator drive 13, 13', door drive 16, 16', etc., controlled by it. The communication by way of the signal line 5''' is unidirectional or bidirectional. The signal line 5''' is laid as a buried cable or suspended in the elevator shaft S4. At least one computer program is loaded into the processor from the computer readable data memory and executed. The computer program controls the movement of the elevator car 12, 12' and the opening and closing of the elevator doors 10.1, 10.1', 10.2, 10.2', 10.3, 10.3' and of the car door 11, 11'. The elevator control 17, 17' obtains data about the instantaneous position of the elevator car 12, 12' in the elevator shaft S4 from an item of shaft information. The elevator installation can comprise substantially more elevators, such as a group with six or eight elevators; with double and triple cars; with several cars, which are arranged one above the other and movable independently of one another, per elevator shaft; with elevators without counterweight, with hydraulic elevators; etc. In addition, the communication between components of the elevator installation A and the elevator control 17, 17' can also be carried by way of radio instead of by way of a laid signal line 5'''.

According to FIG. 1 at least one terminal 9.1, 9.2, 9.3 is arranged near an elevator door 10.1, 10.1', 10.2, 10.2', 10.3, 10.3'. The terminal 9.1, 9.2, 9.3 is, for example, mounted on a building wall or stands in isolation in a space in front of an elevator door 10.1, 10.1', 10.2, 10.2', 10.3, 10.3'. The terminal 9.1, 9.2, 9.3 communicates in at least one local radio network 5 with at least one mobile identification device 6. For this purpose the terminal 9.1, 9.2, 9.3 comprises at least one transmitting unit and at least one receiving unit. The mobile identification device 6 is, for example, a Radio Frequency Identification (RFID) card, which is carried by a passenger, with at least one coil, at least one data memory and at least one processor. The radio frequency used by the terminal 9.1, 9.2, 9.3 is, for example, 125 kHz, 13.56 MHz, 2.45 GHz, etc. The mobile identification device 6 takes up inductive energy by way of its coil from the electromagnetic field of the transmitting unit and is thus activated in terms of energy. The activation in terms of energy is carried out automatically as soon as the mobile identification device 6 is located in the range of the electromagnetic field of a few centimeters up to one meter of the transmitting unit. As soon as the mobile identification device 6 is activated in terms of energy, the processor reads out a destination floor code and/or identification code which is or are filed in the data memory and which is or are transmitted by way of the coil to the receiving unit. The energy-activation of the mobile identification device and the transmission of the destination floor code or identification code to the transmitting and receiving unit is carried out contactlessly. The receiving unit receives the transmitted destination floor code or identification code and prepares it electronically. For this purpose at least one computer program is loadable from the computer readable data memory into the processor, which recognizes the transmitted destination floor code or identification code. The terminal 9.1, 9.2, 9.3 has at least one input, such as a button or a touch sensitive screen. A destination floor code or the identification code can also be input by way of the input and recognized by the computer program.

The terminal 9.1, 9.2, 9.3 comprises at least one signal-bus adapter and communicates in at least one signal bus 5' with at least one call control 7, 7' and at least one databank 8. Each participant in the communication in the signal bus 5' has a unique address. The signal bus 5' is, for example, an LON bus with LON Protocol, an Ethernet network with the Transmission Control Protocol/Internet Protocol (TCP/IP), an Attached Resources Computer Network (ARCNET), etc. The terminal 9.1, 9.2, 9.3 has at least one computer readable data memory and at least one processor. At least one computer program is loadable from the computer readable data memory into the processor and performs the communication. Even in large buildings with many floors and elevator installations with several elevators it is possible to install a large number of terminals. A building with 60 floors and eight elevators can have four terminals per floor or, in total, 240 terminals. The length of the signal bus 5' from the terminals 9.1, 9.2, 9.3 to the databank 8 and to the call control 7, 7' can be appreciable. In a case of a LON bus a length of a single transmission path of the communication of around 900 meters and in a case of an Ethernet network 90 meters are permissible. Repeaters and routers can be provided in order to place part transmission paths of the signal bus 5' in functional relationship.

The recognized identification code is communicated by the terminal 9.1, 9.2, 9.3 to the address of the databank 8 by way of the signal bus 5'. The identification code is communicated together with the address of the terminal 9.1, 9.2, 9.3 communicating the identification code. The databank 8 is connected with a signal bus 5' by way of a standard signal-bus adapter 5.1 such as WAGO 734, Registered Jack 45 (RJ45), etc. The databank 8 comprises at least one processor and at least one computer readable data memory and at least one electrical power supply. At least one computer program is loaded into the processor from the computer readable data memory and executed.

The databank 8 keeps, for at least one passenger, at least one passenger profile with data such as at least one predefined destination floor as well as at least one access authorization to floors S1, S2, S3 and spaces of the building. The predefined destination floor can change in terms of time for one and the same input floor. For example, the destination floor changes depending on the programmed habits of the passenger and is different for one and the same input floor at lunchtime and in the evenings. The access authorization is structured zonally in terms of time and/or space. For example, the passenger has access to specific zones of the building only at specific times. In addition, at least one predefined destination floor is kept in the passenger profile for at least one input floor. The passenger himself or herself can manage and change his or her passenger profile by way of the terminal 9.1, 9.2, 9.3. For example, the status of the passenger profile is output to the passenger on the output of the terminal 9.1, 9.2, 9.3 and the passenger can change the data of the passenger profile by way of the input of the terminal 9.1, 9.2, 9.3. The computer program thus reads the passenger profile and checks the access authorization of the passenger, who is identified by an identification code, to the building and assigns a predefined destination floor to the identification code.

The databank 8 additionally keeps, for at least one elevator of the elevator installation A, at least one elevator profile with data such as at least one positioning of the elevator car 12, 12' in the elevator shaft S4. The positioning of the elevator car 12, 12' is also zonally structured in terms of time and/or space. For example, at rush hours the elevator cars 12, 12' are parked in traffic-dependent manner in predefined building zones, in the morning in, for example, the physical zone of the building entrances, at lunchtime in the physical zones of the building restaurant and at evenings in the physical zones of the offices, etc. At least one predefined elevator position is for that purpose kept in the elevator profile. The computer program thus reads the elevator profile and checks whether the conditions, in terms of time and/or space, of the elevator positioning are fulfilled and in a given case generates a travel command for elevator positioning. The travel command with respect to elevator positioning is communicated by way of the signal bus 5' to the call control 7, 7' of the elevator of the elevator installation A. The call control 7, 7' generates, for the travel command with respect to elevator positioning, corresponding travel requests at the elevator control 17, 17' of the elevator.

The databank 8 communicates the predefined destination floor by way of the signal bus 5' to the address of the terminal 9.1, 9.2, 9.3 communicating the identification code. The terminal 9.1, 9.2, 9.3 thereupon communicates by way of the signal bus 5' at least one enquiry with data with respect to the input floor and with respect to the destination floor to the address of the call control 7, 7'. For example, the terminal 9.1, 9.2, 9.3 communicates such an enquiry to all call controls 7, 7' of the elevator installation A. The enquiry is communicated together with the address of the communicating terminal 9.1, 9.2, 9.3. The call control 7, 7' is connected with the signal bus 5' by way of a signal-bus adapter 5.1. The call control 7, 7' comprises at least one processor and at least one computer readable data memory and at least one electrical power supply. At least one computer program is loaded into the processor from the computer readable data memory and executed. The computer program determines, for the indicated input floor and destination floor, travel orders for a destination call. The call control 7, 7' communicates data with respect to the travel orders by way of the signal bus 5' to the address of the enquiring terminal 9.1, 9.2, 9.3 on the input floor. For example, the call control 7, 7' communicates a destination call offer with data with respect to arrival time of the elevator car 12, 12' at the input floor and with respect to arrival time of the elevator car 12, 12' at the destination floor by way of the signal bus 5' to the address of the enquiring terminal 9.1, 9.2, 9.3 on the input floor. The destination call offer is communicated together with the address of the offering call control 7, 7'. If several call controls 7, 7' of the elevator installation were interrogated, the terminal 9.1, 9.2, 9.3 selects the most favorable destination call offer, namely that elevator car 12, 12' indicating the most rapid transport of the passenger to the destination floor. The terminal 9.1, 9.2, 9.3 confirms the communicated or selected destination call offer. The terminal 9.1, 9.2, 9.3 issues to the passenger on at least one output device an optical and/or acoustic acknowledgement of the travel orders. The terminal 9.1, 9.2, 9.3 communicates a selection acknowledgement of the destination call offer to the address of the call control 7, 7' of the selected destination call offer by way of the signal bus 5".

The call control 7, 7' communicates the travel orders to the elevator control 17, 17' by way of at least one serial bus 5". According to FIGS. 2, 5 and 6 a respective call control 7, 7' communicates with a respective elevator control 17, 17' by way of the serial bus 5". For that purpose the call control 7, 7' is connected with the serial bus 5" by way of at least one serial bus adapter 5.2 and the elevator control 17, 17' also has a serial signal-bus adapter for the serial bus 5". The serial bus 5" is a serial standard bus such as Recommended Standard 232 (RS232), Recommended Standard 485 (RS485), Universal Serial Bus (USB), etc., with corresponding standard serial-bus adapters 5.2. The travel orders are translated by the elevator control 17, 17'. According to a first travel order the elevator car 12, 12' is brought to the input floor and the elevator door 10.1, 10.1', 10.2, 10.2', 10.3, 10.3' and the car door 11, 11' are opened. According to a second travel order the elevator door 10.1, 10.1', 10.2, 10.2', 10.3, 10.3' and the car door 11, 11' are closed and the elevator car 12, 12' is brought to the destination floor and the elevator door 10.1, 10.1', 10.2, 10.2', 10.3, 10.3' and the car door 11, 11' are opened.

Figure 3:
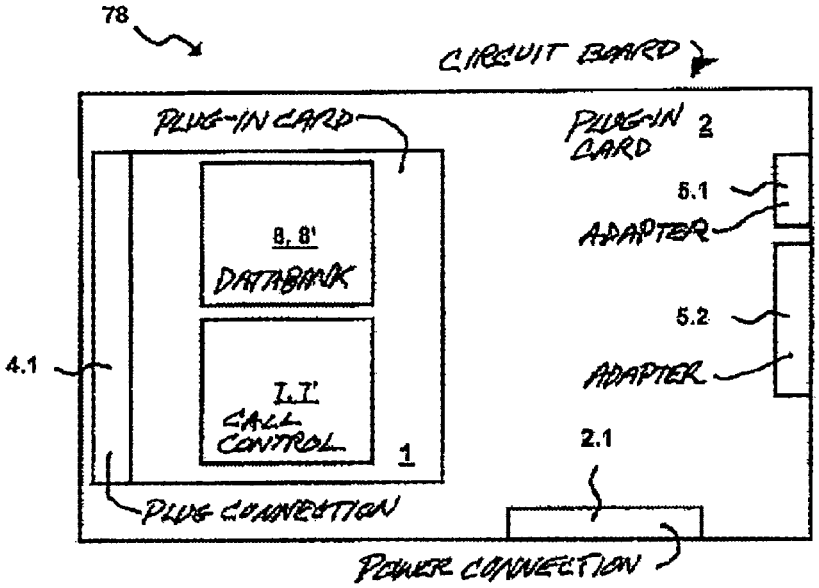
FIG. 3 shows a view of a part of a first exemplifying embodiment of a call control according to FIG. 1 or 2.
Figure 4:
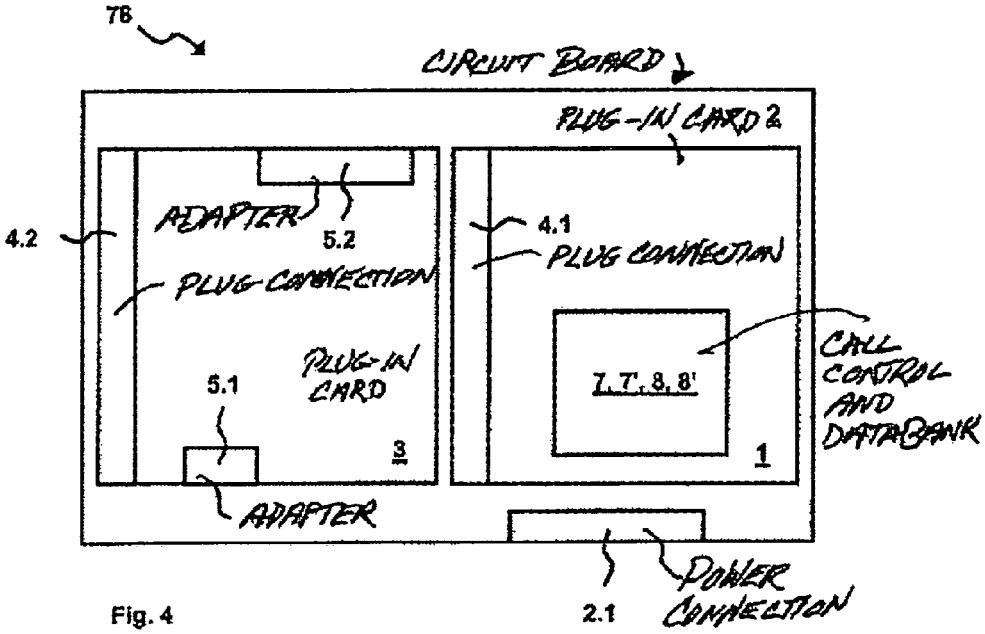
FIG. 4 shows a view of a part of a second exemplifying embodiment of a call control according to FIG. 1 or 2.

FIGS. 3 and 4 show two exemplifying embodiments of a call control 7, 7'. In the form of embodiment according to FIG. 3, two plug-in cards 1, 2 are directly connected together to form a circuit board 78 and in the form of embodiment according to FIG. 4 three plug-in cards 1, 2, 3 are directly connected together to form a circuit board 78. At least one databank 8 and/or safety databank 8' and/or call control 7, 7' is or are arranged on a first plug-in card 1. At least one signal-bus adapter 5.1 and/or at least one serial-bus adapter 5.2 is or are arranged on a second plug-in card 2. At least one signal-bus adapter 5.1 and/or at least one serial-bus adapter 5.2 is or are arranged on a third plug-in card 3. More than one signal-bus adapter 5.1 or more than one serial bus adapter 5.2 can be mounted on a plug-in card 2, 3. The circuit board 78 is mounted as a push-in module in a terminal 9.1, 9.2, 9.3 or an elevator control 17, 17'.

The first plug-in card 1 carries the databank 8 and/or the safety databank 8' and/or the call control 7, 7' as well as the electrical wiring and electrical power supply of these components. The first plug-in card 1 is connected with the second plug-in card 2 by way of a first plug connection 4.1. According to FIG. 3 the first plug-in card 1 has either a databank 8 or a safety databank 8' as well as a call control 7, 7'. According to FIG. 4 the first plug-in card 1 has a databank 8 or a safety databank 8' or a call control 7, 7'.

The second plug-in card 2 carries the first plug-in card 1, the signal-bus adapter 5.1 as well as at least one electrical power connection 2.1, the serial-bus adapter 5.2 or the third plug-in card 3 and the wiring and electrical power supply of these components. According to FIG. 3 the signal-bus adapter 5.1 as well as the serial-bus adapter 5.2 are directly mounted on the second plug-in card 2. According to FIG. 4 signal-bus adapter 5.1 as well as the serial-bus adapter 5.2 and the electrical wiring and electrical power supply thereof are mounted on the third plug-in card 3. According to FIG. 4 the third plug-in card 3 is connected with the second plug-in card 2 by way of a second plug connection 4.2. The first plug-in card 1 and the second plug-in card 2 can be arranged on the same side or different sides of the second plug-in card 2. The plug connections 4.1, 4.2 are standard, reversible multi-plug connections.

The electrical power connection 2.1 is also a standard, reversible multi-plug connection such as a WAGO 734 and supplies a 24 V electrical direct voltage at a maximum of 6 A electrical current for the circuit board 78. The electrical power connection 2.1 can, however, also be supplied by way of the signal bus 5' and/or the serial bus 5" and be integrated in a signal-bus adapter 5.1 and/or in a serial-bus adapter 5.2. In the form of embodiment of an RJ45 plug the electrical power connection 2.1 supplies an electrical direct voltage of 48 V and an electrical current of at most 350 mA for the circuit board 78. In the form of embodiment of a USB plug the electrical power connection 2.1 supplies an electrical direct voltage of 5 V and an electrical current of at most 100 mA for the circuit board 78.

Figure 5:
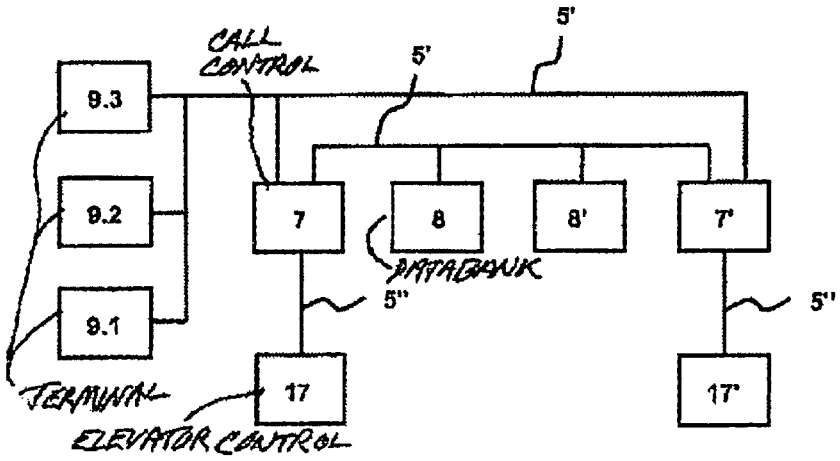
FIG. 5 shows an illustration of a first exemplifying embodiment of the communication between the terminal and the call control of an elevator installation according to FIGS. 1 to 4.
Figure 6:
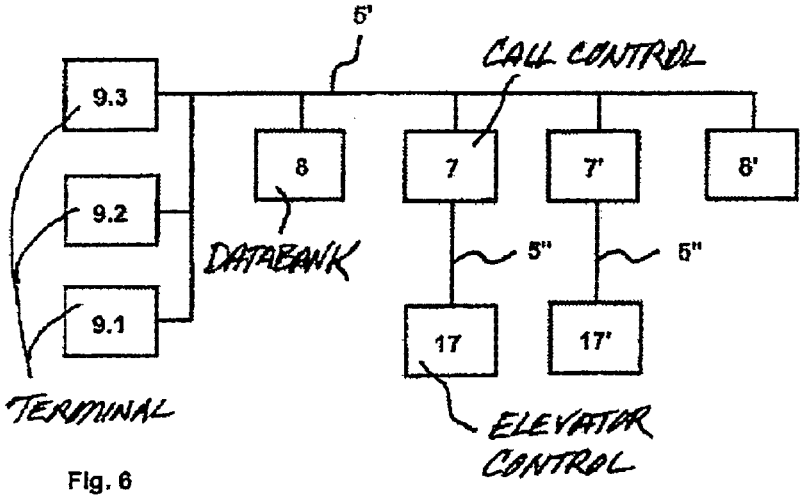
FIG. 6 shows an illustration of a second exemplifying embodiment of the communication between the terminal and the call control of an elevator installation according to FIGS. 1 to 4.

FIGS. 5 and 6 show two exemplifying embodiments of the communication between participants in the signal bus 5' and in the serial bus 5" of the elevator installation A. As already previously described the terminals 9.1, 9.2, 9.3 communicate with the databank 8 and the call control 7, 7' by way of the signal bus 5', whilst the call control 7, 7' communicates with the elevator control 17, 17' by way of the serial bus 5". In order to ensure a high level of serviceability of the communication the passenger profile of the databank 8 is replicated on at least one safety databank 8'. According to FIG. 5 the terminals 9.1, 9.2, 9.3 communicate by way of a first signal bus 5' with the call controls 7, 7', whilst the call controls 7, 7', the databank 8 and the safety databank 8' communicate with one another by way of a second signal bus 5'. The first signal bus 5' between the terminals 9.1, 9.2, 9.3 distributed to all floors in the building and the call control 7, 7' is an economic, robust LON bus with a long transmission path. The second signal bus 5' between the call controls 7, 7' and the databank 8 and the safety databank 8' is an Ethernet network with a high transmission rate and short transmission path. According to FIG. 6 the terminals 9.1, 9.2, 9.3, the call controls 7, 7', the databank 8 and the safety databank 8' communicate by way of a single signal bus 5'.

In the event of failure of an elevator of the elevator installation A the call control 7, 7' of the failed elevator no longer creates travel orders for an enquiring terminal 9.1, 9.2, 9.3, but the at least one remaining call control 7, 7' of an operationally ready elevator of the elevator installation A still creates travel orders for an enquiring terminal 9.1, 9.2, 9.3.

An existing elevator installation of a building can be retrofitted in simple and quick manner with a call control 7, 7'. In a first step at least one terminal 9.1, 9.2, 9.3 is installed on at least one floor S1, S2, S3 of the building, usually at least one terminal 9.1, 9.2, 9.3 is installed on each floor S1, S2, S3, which is served by the elevator installation A, of the building. In a second step at least one call control 7, 7' and/or at least one databank 8 is or are installed; in practical manner the call control 7, 7' or the databank 8 is pushed into a terminal 9.1, 9.2, 9.3 and/or an existing elevator control 17, 17'. In a third step the terminal 9.1, 9.2, 9.3 is connected by way of a signal bus 5' with the call control 7, 7' and/or the databank 8. In a fourth step the call control 7, 7' is connected by way of a serial bus 5" with the existing elevator control 17, 17'. Existing terminals on floors S1, S2, S3 as well as in the elevator car 12, 12' are removed or dissimulated or even only deactivated. The existing elevator control 17, 17' remains unchanged. However, it no longer receives the travel orders from the existing terminals on the floors S1, S2, S3 as well as in the elevator car 12, 12', but from the call control 7, 7' by way of the serial bus 5".

In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims. I therefore claim as my invention all that comes within the scope and spirit of these claims.

The invention claimed is:

1. An elevator control apparatus comprising:

a first elevator control circuit plug-in card;

a second elevator control circuit plug-in card, the first and second elevator control circuit plug-in cards being connected to form an elevator system circuit board;

an elevator call control arranged on the first elevator control circuit plug-in card, the elevator call control being configured to receive input floor information and destination floor information from an elevator terminal using a signal bus and to generate travel orders; and a signal bus adapter coupling the second elevator control circuit plug-in card to the signal bus to communicate the travel orders from the elevator call control to the signal bus.

2. The apparatus according to claim 1 wherein the apparatus is part of an elevator installation.

3. The apparatus according to claim 1 further comprising the elevator terminal for generating the input floor information and the destination floor information.

4. The apparatus according to claim 1 further comprising at least one databank storing at least one passenger profile.

5. The apparatus according to claim 4 wherein the at least one databank is arranged on the first elevator control circuit plug-in card.

6. The apparatus according to claim 1 further comprising at least one databank storing at least one elevator profile.

7. The apparatus according to claim 6 wherein the at least one databank is arranged on the first elevator control circuit plug-in card.

8. The apparatus according to claim 1 wherein the elevator system circuit board is configurable as a push-in module of the elevator terminal.

9. The apparatus according to claim 1 wherein the elevator system circuit board is configurable as a push-in module of an elevator control.

10. A method of receiving elevator information comprising the steps of:

providing a first plug-in card and a second plug-in card, the first and second plug-in cards being coupled together;

coupling a signal bus to a signal-bus adapter on the second plug-in card;

receiving, using an elevator call control and through the signal bus, elevator input floor data and elevator destination floor data, the elevator call control being arranged on the first plug-in card; and generating travel orders from the elevator call control to the signal bus at the signal-bus adapter.

11. The method according to claim 10, further comprising recognizing, using an elevator terminal on an input floor, at least one identification code.

12. The method according to claim 11, further comprising transmitting the at least one identification code to at least one databank stared arranged on the first plug-in card or the second plug-in card, the databank storing an association of a passenger profile with the at least one identification code.

13. The method according to claim 12, further comprising sending destination floor information to the elevator terminal through the signal bus, the destination floor information being based at least in part on the passenger profile.

14. The method according to claim 10, further comprising:

creating one or more of the travel orders using the elevator call control; and transmitting the one or more travel orders to at least one elevator control using at least one serial bus as the signal bus.

15. An elevator call control apparatus comprising:

a first elevator control circuit means;

a second elevator control circuit means, the first and second elevator control circuit means being connected to form an elevator system circuit means;

an elevator call control means arranged on the first elevator control circuit means; and a signal bus adapter means for coupling the second elevator control circuit means to a signal bus.

16. A method of receiving elevator information comprising the steps of:

installing, in an elevator installation, a primary elevator operation component;

installing, in the elevator installation, a secondary elevator operation component, the primary and secondary elevator operation components being configured to communicate with each other;

installing, in the elevator installation, an elevator call unit arranged on the primary elevator operation component, the elevator call unit being configured to generate elevator instructions based at least in part on start floor information and end floor information; and installing, in the elevator installation, a communication adapter arranged on the secondary elevator operation component for communicating the elevator instructions to a signal bus.

17. The method according to claim 16, wherein the elevator installation is an existing elevator installation undergoing a retrofit.

18. An elevator installation comprising:

at least one elevator terminal;

a first elevator control circuit plug-in card;

a second elevator control circuit plug-in card, the first and second elevator control circuit plug-in cards being connected to form an elevator system circuit board;

an elevator call control arranged on the first elevator control circuit plug-in card, the elevator call control being configured to receive input floor information and destination floor information from the elevator terminal using a signal bus and to generate travel orders; and a signal bus adapter for coupling the second elevator control circuit plug-in card to the signal bus to communicate the travel orders from the elevator call control to the signal bus.

* * * * *